United States Patent [19]

Suzuki et al.

[11] Patent Number: 4,498,861

[45] Date of Patent: Feb. 12, 1985

[54] METHOD FOR CONTROLLING COMBUSTION IN INDUSTRIAL FURNACES

[75] Inventors: Tomio Suzuki; Kotaro Morimoto, both of Kobe, Japan

[73] Assignee: Kobe Steel, Limited, Kobe, Japan

[21] Appl. No.: 181,384

[22] Filed: Aug. 22, 1980

[30] Foreign Application Priority Data

| | | | |
|---|---|---|---|
| Apr. 9, 1979 | [JP] | Japan | 54-43211 |
| Aug. 22, 1979 | [JP] | Japan | 54-107524 |
| Aug. 22, 1979 | [JP] | Japan | 54-107525 |
| Nov. 2, 1979 | [JP] | Japan | 54-142599 |
| Nov. 2, 1979 | [JP] | Japan | 54-142600 |

[51] Int. Cl.[3] ..... F23N 5/08

[52] U.S. Cl. ..... 431/12; 431/75; 431/90; 431/189; 236/15 BD; 432/37; 432/49

[58] Field of Search ..... 431/12, 62, 75, 76, 431/189, 354, 89, 90, 186; 236/15 BD, 15 E; 432/49, 37

[56] References Cited

U.S. PATENT DOCUMENTS

| | | | |
|---|---|---|---|
| 2,991,832 | 7/1961 | Dailey | 432/49 |
| 3,199,852 | 8/1965 | Koinis et al. | 431/76 |
| 4,043,742 | 8/1977 | Egan et al. | 431/12 |
| 4,043,743 | 8/1977 | Seider | 431/76 |
| 4,330,260 | 5/1982 | Jorgensen et al. | 431/12 |

FOREIGN PATENT DOCUMENTS

| | | | |
|---|---|---|---|
| 0131128 | 10/1979 | Japan | 431/189 |

*Primary Examiner*—Samuel Scott
*Assistant Examiner*—Margaret A. Focarino
*Attorney, Agent, or Firm*—Oblon, Fisher, Spivak, McClelland & Maier

[57] ABSTRACT

A method for controlling combustion of atomized fuel in industrial furnaces, in which flame radiation and temperature distributions in a furnace are controlled into optimum conditions in terms of heat efficiency by adjusting a feed rate of an atomizing medium and/or a distal end position of a burner.

11 Claims, 40 Drawing Figures

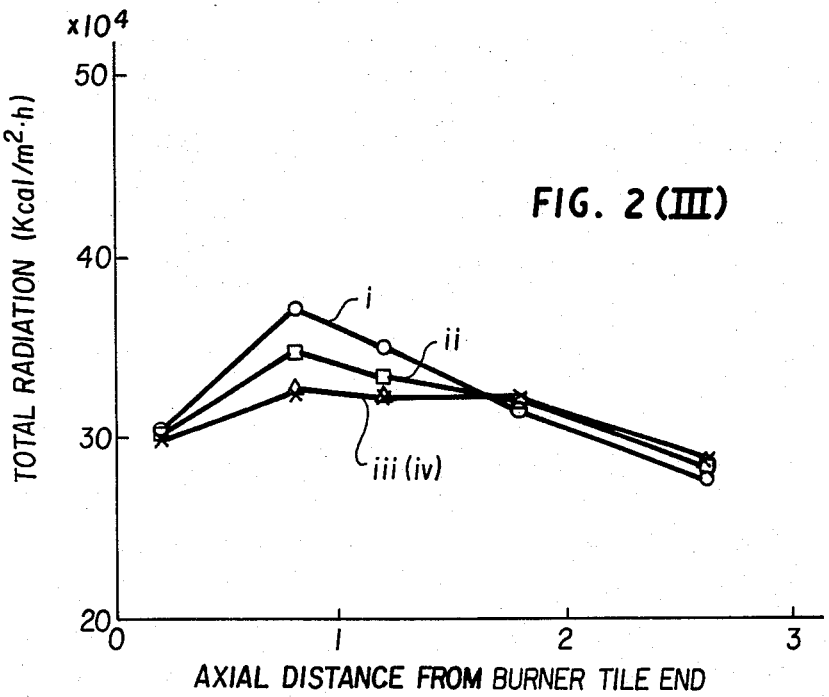
FIG. 2(III)

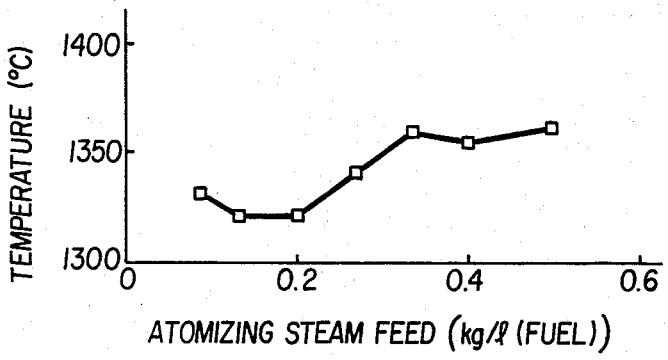
FIG. 3
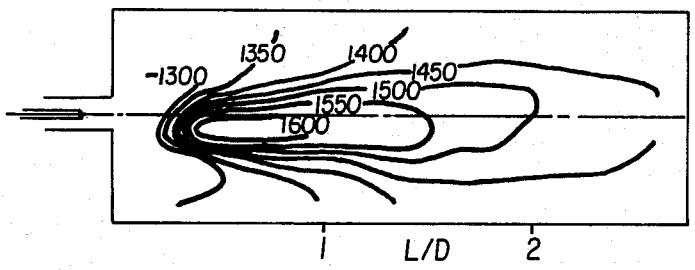
FIG. 4 (I)
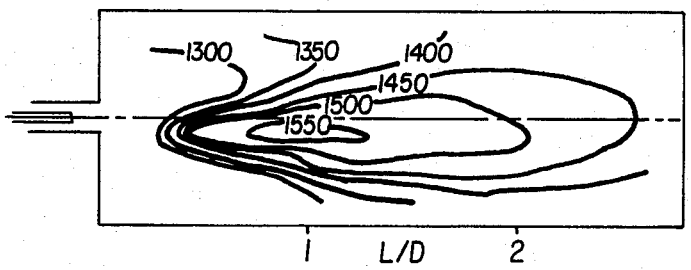
FIG. 4 (II)

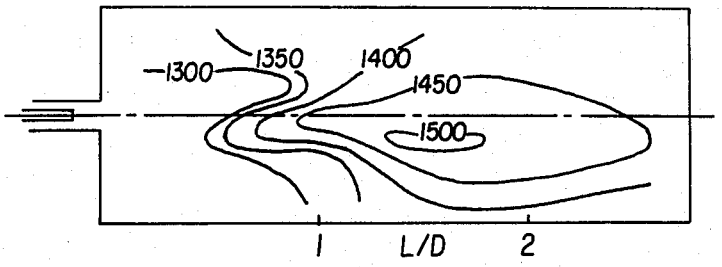
FIG. 4(III)

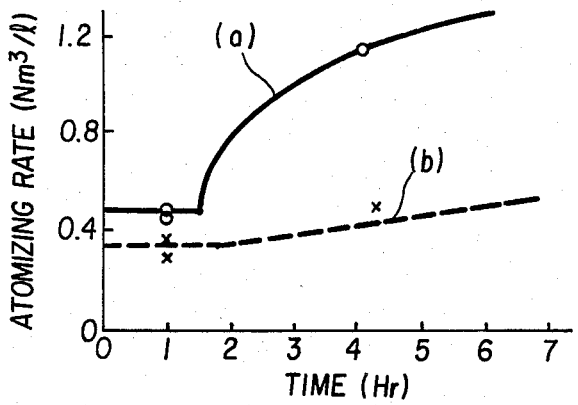
FIG. 11 (I)
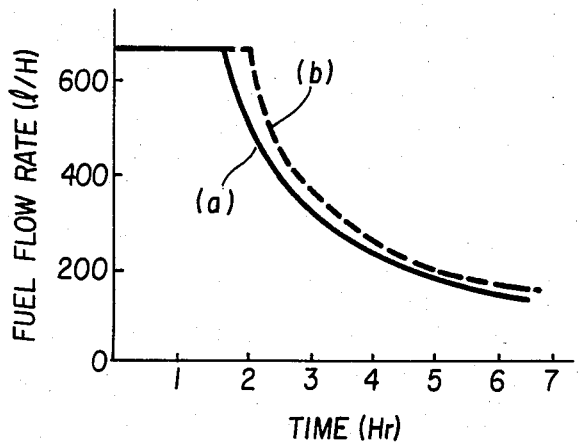
FIG. 11 (II)
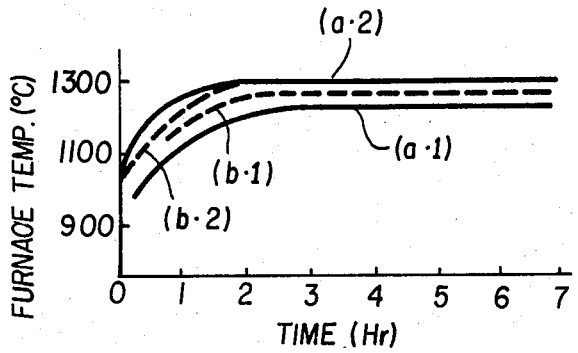
FIG. 11 (III)

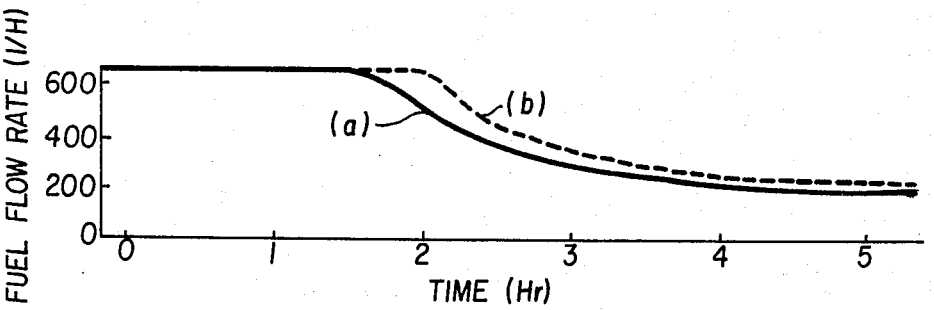
FIG. 13(III)

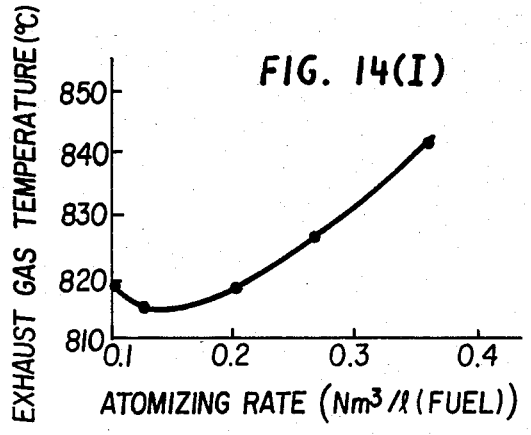
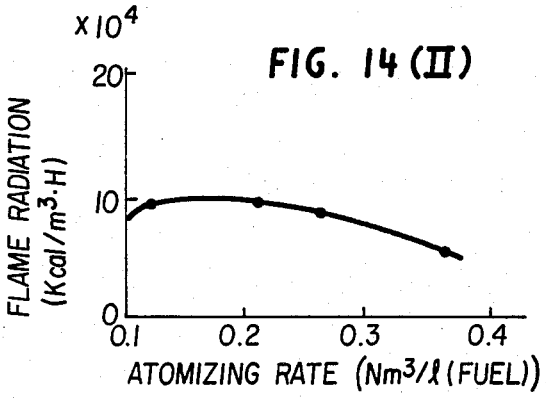
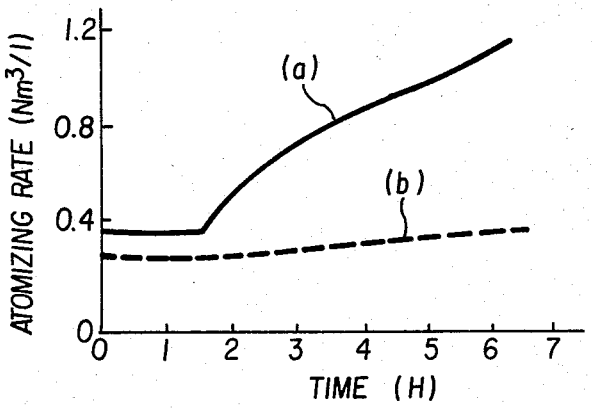
FIG. 16

METHOD FOR CONTROLLING COMBUSTION IN INDUSTRIAL FURNACES

BACKGROUND OF THE INVENTION

This invention relates to a method for controlling combustion in industrial furnaces, and more particularly to a method for creating optimum conditions of flame radiation and temperature distributions to attain high heat efficiency in a combustion process in an industrial furnace by controlling the feed rate of an atomizing medium and/or the tip end position of a burner.

There have thus far been proposed various energy-saving combustion methods, which are largely classified into reduction of heat loss, utilization of waste heat, utilization of potential heat of hot works (e.g., hot ingots), intensification of operation control, and so forth. Taking a soaking pit as an example, the methods for reducing heat loss include combustion at a low air ratio (combustion with controlled oxygen concentrations), strengthening heat insulation of furnace walls with ceramic fiber, and strengthening seals of the furnace, the methods for utilizing waste heat include elevating preheating temperature of combustion air, preheating soaking works and combined use of a waste heat boiler, and the methods for utilizing potential heat of hot ingots include shortening the track time and optimization of heating pattern. These conventional methods belong to macro-techniques and are regarded as relatively fundamental measures.

SUMMARY OF THE INVENTION

Taking a different viewpoint from the above-mentioned conventional methods, the present invention contemplates providing a method for controlling combustion of an atomized fuel in an industrial furnace on the basis of correlation between flame radiation and temperature distributions in the furnace and an atomizing medium feed rate and/or a distal end position of a burner over given fuel flow rates.

More particularly, it is an object of the present invention to provide a method for creating optimum conditions of flame radiation and temperature distributions from the standpoint of heat efficiency in combustion processes in various industrial furnaces by controlling the atomizing medium feed rate and/or the distal end position of a burner.

According to the present invention, there is provided a method for controlling combustion of atomized fuel in an industrial furnace, including: predetermining the correlation between the flame radiation and temperature distributions in the furnace and the feed rate of an atomizing medium over fuel flow rate; passing signals indicative of the fuel flow rate through a rationing means; and automatically controlling the feed rate of the atomizing medium to an optimum value in response to signals received from the rationing means.

The optimum conditions of the flame radiation and temperature distributions in the furnace as well as the suitable range of the atomizing medium feed rate very depending upon the operating characteristics of the furnace involved, the purpose of the combustion, the kind of the fuel, etc. In a case where slow combustion is by the use of a fluid-atomizing type oil burner, the feed rate per liter of fuel is controlled greater than a critical value at which combustible substances begin to be produced in exhaust gases in an unacceptably increased concentration and below 0.26 $Nm^3/l$ in air-atomization or below 0.19 kg/l in steam-atomization.

In the control of a combustion process in a top one-way firing type soaking pit including a soaking period, it is preferred to control the feed rate of the atomizing medium per liter of the fuel to a value greater than 0.5 $Nm^3/l$ in air-atomization or a value greater than 0.4 kg/l in steam-atomization.

According to another aspect of the present invention, in addition to or independently of the above-mentioned control of the atomizing medium flow rate, the tip end position of a burner is selected to have maximum flame radiation in a desired locality of the furnace according to predetermined correlation between the tip end position of the burner and the distribution of flame radiation in the furnace over fuel flow rate or combustion air flow rate.

The above and other objects, features and advantages of the invention will become apparent from the following particular description of the invention and the appended claims, taken in conjunction with the accompanying drawings.

BRIEF DESCRIPTION OF THE DRAWINGS

In the accompanying drawings:

FIG. 3 is a graph showing the relation between feed rate of atomizing steam and exhaust gas temperature;

FIGS. 4(I) to 4(III) and FIGS. 5(I) to 5(II) are furnace temperature distribution diagrams;

FIGS. 7(I) and 7(II) are schematic views showing an upper one-way firing type soaking pit in vertical and horizontal sections, respectively;

FIGS. 11(I) to 11(III) are graphs showing transitional changes in atomizing rate, fuel flow rate and furnace temperature, respectively;

FIGS. 14(I) and 14(II) are graphs showing the relation between atomizing rate and exhaust gas temperature and the relation between atomizing rate and flame radiation, respectively, FIGS. 15(I) and 15(II) are graphs showing air-atomizing rate and transitional changes in flow rate of heavy oil during combustion process, respectively;

FIG. 16 is a graph showing transitional changes in atomizing rate;

DETAILED DESCRIPTION OF THE PREFERRED EMBODIMENTS

Figure 1:
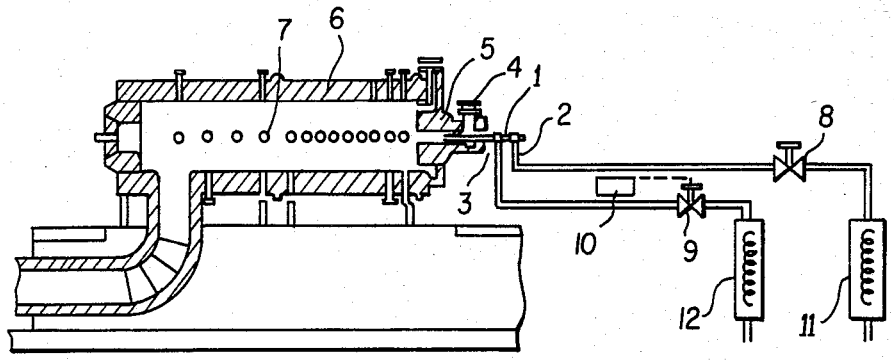
FIG. 1 is a schematic view showing an example of combustion furnace.

Referring to the accompanying drawings and first to FIG. 1, there is shown a one-way firing type combustion furnace with a horizontally disposed cylindrical refractory wall, having dimensions of 1 m in inner diameter D and 4 m in length Lo, which was used in the following combustion tests. With the combustion furnace of FIG. 1, fuel is supplied through a fuel supply port 2 of an oil burner 1 and, prior to injection into the furnace, atomized into fine particles within the burner by an atomizing medium such as air or steam which is supplied through an atomizing medium supply port 3. Combustion air is fed to an air register 4 by a blower and mixed into fuel flows within a burner tile 5 and the furnace to form diffusing flames. The flow rate of fuel is regulated by means of a valve 8 which is operated manually or automatically on the basis of signals indicative of the furnace temperature, reading the flow rate on a fuel flow meter 11. The flow rate of the atomizing medium is regulated by means of a valve 9 which is operated manually or automatically by a pressure regulator valve 10 or other suitable means on the basis of signals indicative of the pressure of fuel oil upstream of the burner, and indicated on a flow meter 12. The intensity of flame radiation within the furnace is measured by a radiometer which is located in a peep window 7 in a furnace wall 6.

Combustion tests were conducted under the following conditions.

Burner tile: Straight (with an aperture diameter of 144 mm)

Burner: Internal-mixing air- or steam-atomization type

Burner tip: Straight (with a single hole of 5 mm in diameter)

Combustion rate: $40\times10^4$ Kcal/h

Air ratio: 1.15

Combustion air temperature: 320° C.

Preset furnace temperature: 1300° C.

Figure 2I:
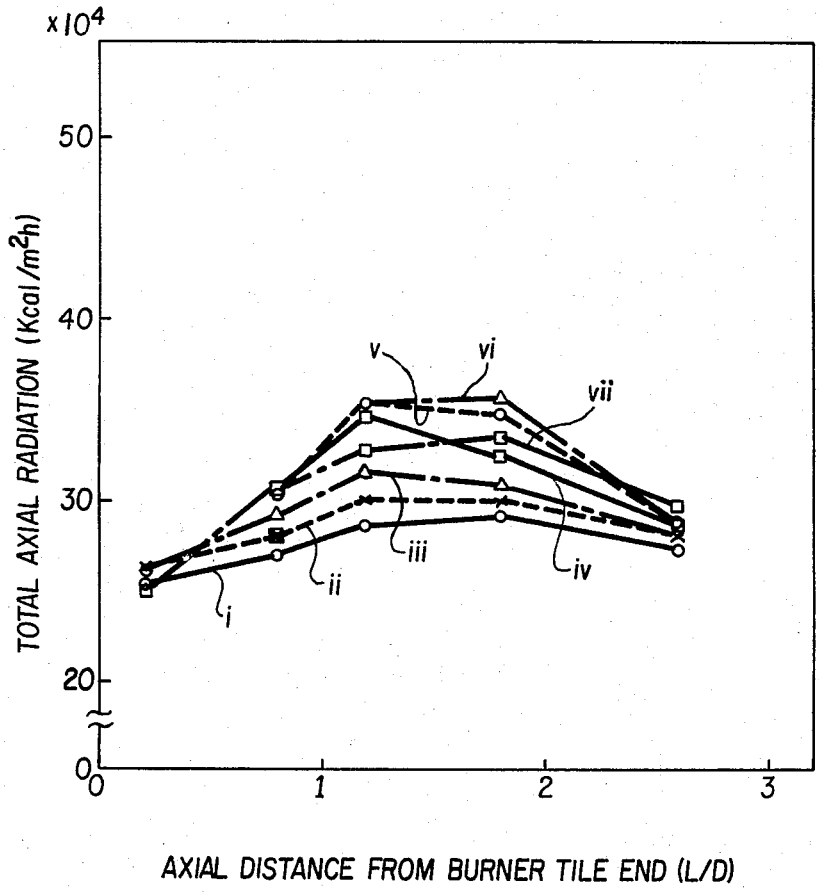
FIGS. 2(I) to 2(III) are graphs showing axial distributions of total radiation.

FIG. 2(I) is a graph showing the relation between the feed rate of atomizing steam and the axial distribution of flame radiation during combustion of fuel oil (C-grade heavy oil) which was injected into the above-described furnace after atomization by steam. In this graph, curves i to vii represent different feed rates of atomizing steam per liter of fuel oil, namely, represent the atomizing rates of 0.493 kg/l, 0.395 kg/l, 0.329 kg/l, 0.263 kg/l, 0.190 kg/l, 0.132 kg/l, and 0.087/l, respectively. The graduation on the abscissa of this graph represents the ratio (L/D) of the distance L from the burner tile end to the inner diameter D of the furnace. The total quantity of radiation is a sum of the furnace wall radiation and the flame radiation. In this experiment, the rate of atomization was varied over a short time period so that the variation in the furnace wall temperature was small and the furnace wall radiation remained almost the same. Therefore, the variation in the total quantity of radiation substantially reflects the variation in the flame radiation. As seen in the graph of FIG. 2(I), the flame radiation is gradually increased with reductions in the rate of steam atomization relative to the fuel flow rate, but it shows a decreasing tendency when the quantity of atomization is reduced to an excessive degree. The flame radiation becomes higher in the range of about 0.190–0.132 kg/l.

Figure 2:
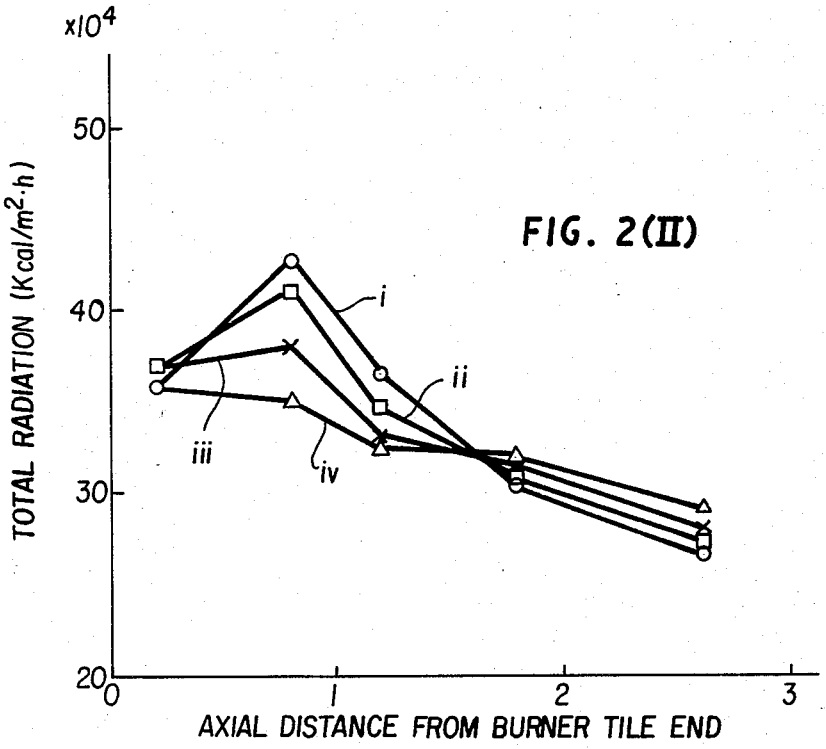

FIGS. 2(II) and 2(III) similarly show the relation between the atomizing medium feed rate and the axial distribution of total radiation (radiation by furnace wall+flame radiation) in combustion tests using air- and steam-atomization, respectively, under the same conditions as in FIG. 2(I) except that the burner was provided with a tip having four injecting holes of 2.5 mm in diameter and a spray cone angle of 10° and that the burner tile was of a conical type. In these tests, the atomizing medium feed rate was also varied in a short time period so that the variation in the temperature of furnace wall was ignorably small and the radiation by the furnace wall remained almost the same. It follows that a variation in the total radiation indicates a variation in the flame radiation. In FIG. 2(II) of air-atomization, curve i is a plot of an atomizing air feed rate of 0.17 $Nm^3$ per liter of the fuel, curve ii is of 0.26 $Nm^3/l$, curve iii is of 0.34 $Nm^3/l$, and curve iv is of 0.43 $Nm^3/l$. In FIG. 2(III) of steam-atomization, curve i is a plot of an atomizing steam feed rate of 0.13 kg/l, curve ii is of 0.19 kg/l, curve iii is of 0.25 kg/l, and curve iv is of 0.32 kg/l. As seen in these figures, the intensity of flame radiation is increased by reductions in the atomizing medium feed rate in a range within an axial distance of about 1.6 m from the burner tile end. It is also observed that especially the total radiation and thus the flame radiation is increased at an atomizing rate below about 0.26 $Nm^3/l$ in air-atomization and below about 0.19 kg/l in steam-atomization. The increase of flame radiation which takes place in the region within an axial distance of about 1.6 m upon reducing the atomizing rate regardless of the kind of atomizing medium is considered to be attributable to the fact that the region corresponds substantially to the flame area and the combustion is slowed down with increased luminous flame radiation due to the reduction of the atomizing rate. On the other hand, the slight reduction of the total radiation at points downstream of the above-mentioned region is considered to be due to lowered downstream combustion gas temperature which is caused by high radiation in the upstream region and to lowered non-luminous gas radiation which is the major flame radiation in the downstream region.

Reference is now made to FIG. 3 which shows the variations in the exhaust combustion gas temperature which was measured by varying the feed rate of atomizing steam. The exhaust gas temperature was measured at a position of L/D=4 (at the furnace end remote from the burner). The measured exhaust gas temperature reflects the quantity of heat transfer within the furnace by the burning flames, a lower exhaust gas temperature indicating a greater quantity of heat transfer within the furnace. It is clear from the graph that the exhaust gas temperature is lowered by reductions in the feed rate of atomizing steam, resulting in increases in the quantity of heat transfer within the furnace. This is because the flame radiation is increased by reductions in the rate of atomization as shown in the graph of FIG. 2. The phenomenon of the exhaust gas temperature increasing again (and thus in-furnace heat transfer is reduced) when the quantity of atomization is reduced below 0.087 kg/l is atributable to a reduced intensity of flame radiation at that atomization rate. It is known therefrom that the in-furnace heat transfer is maintained at the maximum to ensure good heat efficiency when the rate of atomizing steam is in the range of about 0.190 to 0.132 kg/l.

The temperature distribution in the combustion furnace is also an important factor for achieving uniform heating of a work. FIGS. 4(I), 4(II) and 4(III) show the influences of the rate of atomizing steam on the temperature distribution in a sectional area containing the longitudinal axis of the furnace, for the cases where the rate of atomizing steam is 0.395 kg/l, 0.263 kg/l and 0.132 kg/l, respectively. In these graphs, the figures indicate the temperatures along the respective isothermal lines. The maximum flame temperature was 1651° C., 1602° C. and 1523° C. in the cases of FIGS. 4(I) to 4(III), respectively. It is clear from comparison of these figures that the maximum flame temperature is lowered with reductions in the rate of atomizing steam, resulting in a flattened temperature distribution.

Figure 5:
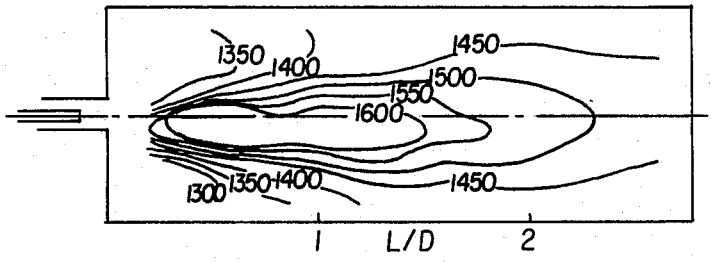
Figure 5:
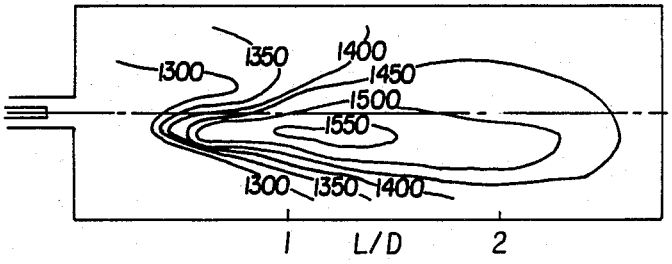

FIGS. 5(I) and 5(II) show temperature distributions in those cases where air was used as an atomizing medium at the rates of 0.542 $mm^3/l$ and 0.181 $mm^3/l$, respectively. The maximum flame temperature was 1747° C. in the case of FIG. 5(I) and 1622° C. in the case of FIG. 5(II). As is clear from these figures, the air-atomization shows characteristics similar to those of steam-atomization.

As a result of the foregoing combustion tests, it has been found that the temperature distribution in the furnace and the distribution characteristics of flame radiation can be controlled to create desired conditions by adjusting the rate of atomization, even in the same industrial furnace and during combustion by the same burner. This phenomenon is considered to occur through the following mechanism. Generally, in luminous-flame radiation, it is known that the sprayed fine particles of the fuel oil are pyrolyzed by the heat transferred from the ambient, and a sort of solid radiation takes place due to coke-like soot of residual carbon form which is produced through polymerization or condensation reactions. In a case where the rate of atomization is reduced as mentioned hereinbefore, the particle size of the fuel oil becomes greater and the velocity of injected fuel through a nozzle hole of a given diameter is lowered, accelerating the production of the above-mentioned soots of residual carbon form. As a result, the flame radiation is enhanced, the heat transfer within the furnace is increased, and the exhaust gas temperature is lowered. If the rate of atomization is reduced extremely, the combustible loss of heat is increased and in addition the soot of residual carbon form becomes to have a lowered radiation capacity due to increases of its particle size, resulting in reduced flame radiation, lowered heat transfer within the furnace and an elevated exhaust gas temperature.

The method of the present invention is based on the above-discussed findings concerning the relation of the rate of atomization with the flame radiation and temperature distributions within the furnace. In the practical applications, the rate of atomization should be adjusted to values suitable for the particular type of the industrial furnace involved, since the optimum conditions of the distribution of flame radiation or temperature in various industrial furnaces vary from one another depending upon the operating characteristics of the furnaces and the purposes of the combustion. For instance, in an aluminum melting furnace, a heating zone of a heating furnace or a two-way firing type soaking pit in which the residence time of the exhaust combustion gas in the furnace is short and the temperature distribution (temperature variations between different portions of the furnace) is out of question, it is advantageous to increase the heat transfer in the furnace by reducing the rate of atomization. In a case where steam-atomization is used for a furnace which is provided with a straight tile and a straight burner, it is recommended to control the rate of atomizing steam to a range of from about 0.132 to 0.190 kg/l where the exhaust gas temperature is lowest according to the relation of FIG. 3, thereby enhancing the heat transfer in the furnace and reducing the fuel consuption prime unit of the fuel.

Figure 6:
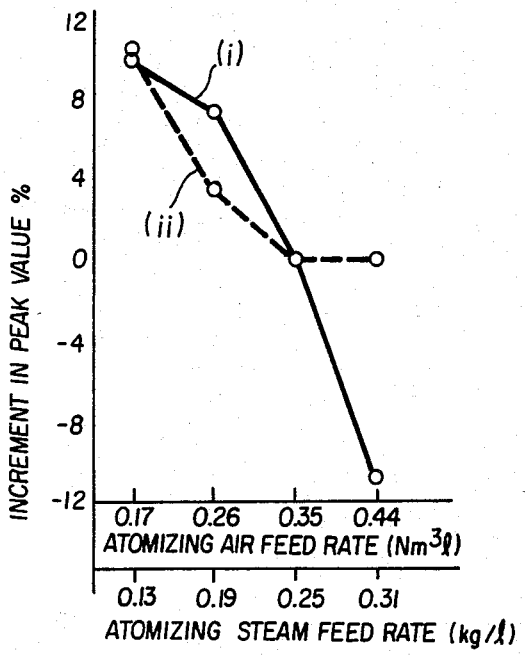
FIG. 6 is a graph showing increments in the maximum value of total radiation.

It also becomes possible to enhance the maximum value of total radiation by controlling the atomizing air or steam feed rate below the above-mentioned critical values. FIG. 6 shows the relation between the atomizing medium feed rate and the increment in the maximum value of the total radiation, in which average increment is indicated in percentage to a standard value by the atomizing feed rate of the conventional method (0.35 $Nm^3/l$ in air-atomization and 0.31 kg/l in steam-atomization) in each of the cases of C-heavy oil (curve i) and kerosene (curve ii). It is observed therefrom that, with C-heavy oil, maximum radiation is invariably increased when the atomizing medium feed rate is reduced from the standard rate (curve i). On the other hand, with kerosene, the maximum radiation is not increased until the atomizing rate is lowered to a certain value (because C/H of kerosene is smaller than that of heavy oil). In this particular example, the maximum radiation tends to increase when the atomizing rate is lowered because 0.26 $Nm^3/l$ in air-atomization and below 0.19 kg/l in steam-atomization. In any case, the maximum value of the total radiation can be distinctively increased by reducing the atomizing rate below about 0.26 $Nm^3/l$ in air-atomization and below about 0.19 kg/l in steam atomization. However, as mentioned hereinbefore, an extreme reduction of the atomizing rate will result in exhaust gases which contain in a greater concentration combustible substances such as smoke, soot and CO. Therefore, the lower limit of the atomizing rate should be determined in consideration of the characteristics of the furnace concerned and the conditions of combustion. In FIG. 6, the incremental radiation is compared with the total radiation of which more than 50% is the radiation by the furnace wall, so that the actual incremental radiation is more than double the percentage to the maximum value of the total radiation.

Figure 7:
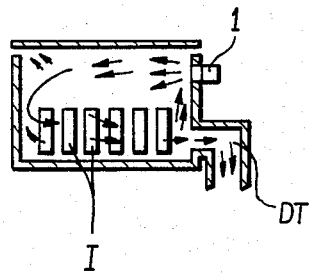
Figure 7:
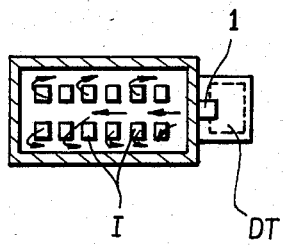

On the other hand, in a top one-way firing type soaking pit which is shown in vertical and horizontal sections in FIGS. 7(I) and 7(II), the combustion gas produced by a burner 1 forms a reversing flow through works I (steel ingots) toward a downtake DT as indicated by arrows. In this case, the combustion gas has a longer residence time in the furnace than in a top two-way combustion type furnace, and, with respect to the heating characteristics of the steel ingots, there is a tendency that the upper portions of the ingots are easily soaked to an excessive degree but their lower portions are susceptible to incomplete heating due to insufficient circulation of the hot combustion gas and heat transfer to the bottom of the pit. In such a soaking pit, for example, if the rate of atomization is reduced to increase the flame radiation in a soaking period of a relatively low combustion rate, the combustion gas temperature downstream of the flame is lowered as shown in FIGS. 2 and 3, undesirably promoting the insufficient heating of the bottom portions of the steel ingots. Therefore, in a one-way firing type soaking pit, the rate of atomization in a soaking period of the final stage should be increased to a value greater than the conventionally accepted rate (0.35 $Nm^3/l$ for air-atomization and 0.31 kg/l for steam-atomization), to a value greater than about 0.5 $Nm^3/l$ preferably greater than about 0.8 $Nm^3/l$ in the case of air-atomization and to a value greater than about 0.4 kg/l preferably greater than about 0.7 kg/l in the case of steam-atomization. By so doing, it becomes possible to control and maintain in optimum conditions the distribution of flame radiation and the temperature within the pit. This contributes especially to prevent oversoaking of the upper portions of the heated works and to improve the quality of the works and reduce the fuel consumption prime unit of the fuel by acceleration of the heating speed in the bottom portions of the works.

Needless to say, the above-described control of the rate of atomization is effective for optimizing the combustion conditions not only in the soaking period but also in the preceding heat period. However, depending upon the operating characteristics of the soaking pit, the control in the heating period is not necessarily needed and it is more advantageous in some case to control the atomization to the conventional level or to reduce it as in the above-mentioned two-way firing type furnace. This is because generally the combustion proceeds at a high rate and the combustion gas has a relative short residence time in the furnace in the soaking period so that in some cases it is more desirable to enhance the flame radiation by decreasing the rate of atomization according to the relation shown in FIGS. 2 and 3, for the purpose of suppressing the loss of the combustion gas heat and promoting the heat transfer effect within the furnace, notwithstanding a slight degree of localized heating which may result.

Figure 8:
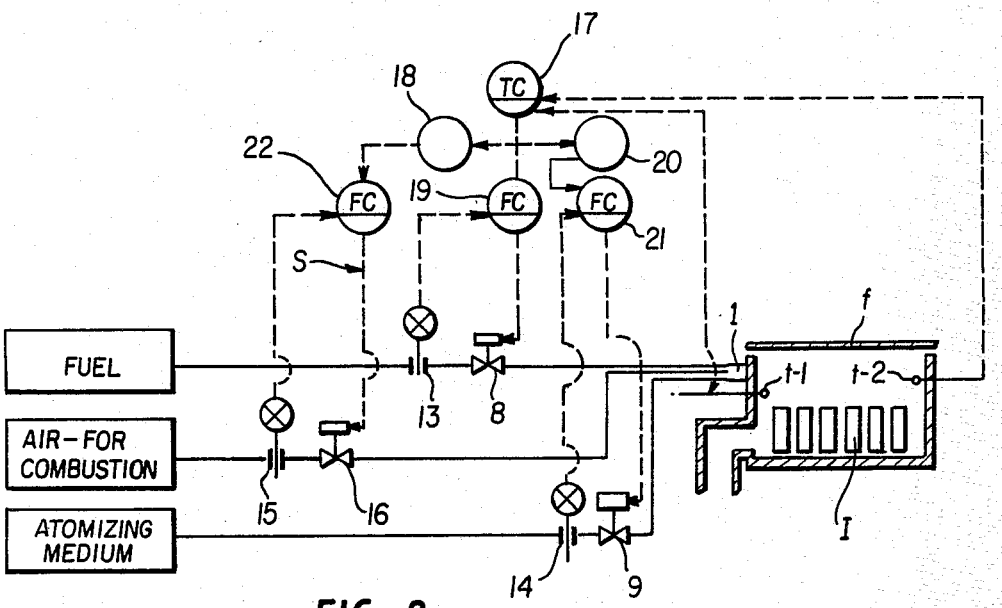
FIG. 8 is a diagram of a combustion control system arrangement.

In this manner, by adjusting the rate of atomization according to its predetermined correlation with the distribution characteristics of flame radiation and furnace temperature over the flow rate of fuel, the combustion in the furnace can be controlled and maintained in conditions optimum for particular operating characteristics of the furnace or purpose of the combustion. FIG. 8 illustrates a system arrangement for putting into practice the above-described control of combustion in an industrial soaking pit. In this figure, indicated at f is a soaking pit, at t-1 and t-2 are temperature detecting probes located at the opposite pit ends, at 17 a temperature control meter, at 18 an air-fuel flow rationing unit, at 19 a fuel flow control meter, at 20 an atomization rate setting unit, and at 21 an atomization rate control meter. Fuel is supplied to a burner 1 of the furnace through a fuel flow rate generator 13 and a fuel flow rate regulator valve 8 and atomized by an atomizing medium which is supplied through an atomizing flow rate generator 14 and an atomization rate control valve 9. Combustion air is supplied to the burner through an air flow rate generator 15 and an air flow rate control valve 16. Signals from the respective furnace temperature probes t-1 and t-2 of the soaking furnace F are fed to the temperature control meter 17 which normally controls the furnace temperature according to a higher reading. Signals from the temperature control meter 17 are fed to the air-fuel rationing unit 18, fuel flow rate control meter 19 and atomization rate setting unit 20, respectively. The flow rates of the fuel and combustion air are controlled in the following manner.

Figure 9:
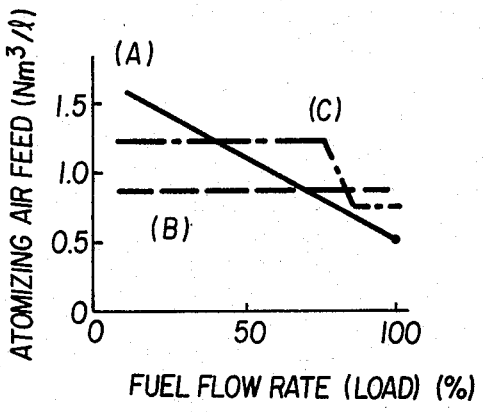
FIG. 9 is a graph showing the relation between combustion load and atomizing rate.

As shown in FIG. 8, the atomization rate setting unit 20 supplies the atomization control meter 21 with signals according to an optimum atomization pattern which is determined in relation with the fuel flow rate as shown in the graph of FIG. 9. In this graph, pattern A has an atomization rate $\alpha_1$ increasing with reductions in the combustion load, pattern B has a constant atomization rate $\alpha_1$ over the entire range of the combustion load, and pattern C has an atomization rate $\alpha_1$ varying only in a particular range of the combustion.

In actual operation, the atomizing rate may be controlled by operating the atomizing rate control valve in response to output signals of the rationing unit which is supplied at its input terminal with signals indicative of the fuel flow rate. Alternatively, the signal A taken out from the combustion air flow control meter may be applied to the atomizing rate control valve. This method uses the rationing unit for controlling both the combustion air flow rate and the atomizing rate. In this case, the atomizing rate is determined by the air-fuel rationing unit, so that the atomizing rate control valve may be operated by a signal which is obtained by adding a bias signal to the signal A or alternatively a bypass pipe may be provided in the atomizing rate control valve.

Figure 10:
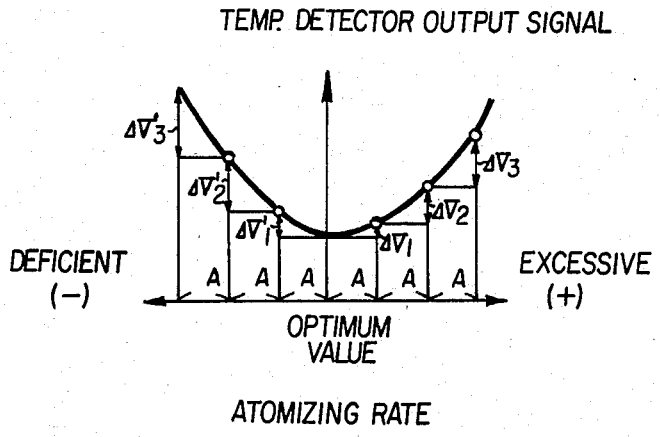
FIG. 10 is a diagram explanatory of the control of atomizing rate by hill-climbing method.

Further, it is possible to control the atomizing rate in response to output signals from a temperature detector which is provided in a fume duct for the exhaust gas. In a furnace like the aforementioned aluminum melter in which the temperature distribution in the furnace is out of question and the combustion gas has a relatively short residence time in the furnace, the atomizing rate is controlled in such a manner as to hold the exhaust gas temperature at a lowest level for obtaining the maximum heat transfer in the furnace. The control may be effected manually but it is advantageous to resort to more precise control by the hill-climbing method. FIG. 10 illustrates the control of the atomizing rate by the hill-climbing method, in which the abscissa represents the atomizing rate, indicating excessive and deficient quantities respectively to the right and left of the optimum value. The ordinate represents the output signal of the temperature detector. As shown in this figure, upon varying the atomizing rate by $\Delta A$, the output signal is varied by $\Delta V$. In this instance, when the atomizing rate is on the right side of the optimum value (excessive side), a variation of $+\Delta A$ in the atomizing rate is met by a variation of $+\Delta V$ in the output signal and a variation of $-\Delta A$ is met by a variation of $-\Delta V$, the respective variations carrying the same positive or negative signs. On the other hand, when the atomizing rate is on the left side of the optimum value (deficient side), the variations in the atomizing rate and the output signal always carry different signs. Therefore, it is possible to judge from the signs of the variations on which side of the optimum value the atomizing rate is. By repeating this judgement, the optimum atomizing rate ($\Delta V \rightarrow 0$) is obtained.

In a combustion in which it is intended to improve the heating characteristics of a work and to accelerate the production of soot of residual carbon form by reducing the atomizing rate, unburned or combustible substances are apt to be discharged with the exhaust gas. In such a case, it is recommended to provide a smoke concentration detector or a carbon monoxide (CO) detector in the fume duct of the exhaust gas, while controlling the atomizing rate such that the output signal from the detector fall in a suitable predetermined range. For example, in a case where the detector is located in a fume duct at the outlet of a two-way firing type soaking pit or of a heating furnace, an extremely high heat transfer efficiency is obtained while avoiding the problems of the exhaust gas, by controlling the atomizing rate such that the CO concentration and the smoke concentration (Bacharach smoke number) fall in the range of 100–400 ppm and in the range of about 3–5, respectively.

Needless to say, any one of the above-described atomizing rate control methods may be applied in consideration of the characteristics of the furnace involved, the purpose of combustion, the accuracy of control required, the energy-saving effects, facilities available, etc.

EXAMPLE 4

Hot ingots were heated and soaked in an top one-way combustion type soaking pit using the control circuit of FIG. 8 and under the conditions as follows.

Maximum combustion rate: 680 l/h
Oil burner: Internal air-atomizing type
Fuel: C-heavy oil
Air ratio: 1.05

FIGS. 11(I) to 11(III) show variations over time in the atomizing rate ($Nm^3/l$), fuel flow rate (l/h) and furnace temperature (°C.), respectively, which were observed when heating the hot ingots under the above conditions. In FIGS. 11(I) and 11(II), the curves a are of the present invention and curves b are of the conventional method. The curves a-1 and a-2 in FIG. 11(III) are of furnace temperatures on the side of and remote from the burner during operation according to the present invention, while curves b-1 and b-2 are plots of similar furnace temperature during operation by the conventional method. As shown in FIG. 11(I), in the method of the present invention, the atomizing air rate was maintained at a constant level of about 0.5 $Nm^3/l$ during the heating period and at a level in excess of about 0.5 $Nm^3/l$ in the soaking period.

With regard to the fuel flow rate (FIG. 11(II)), it is observed that the turn-down commences earlier and thus the fuel consumption is reduced as compared with the combustion by the conventional method.

Figure 12:
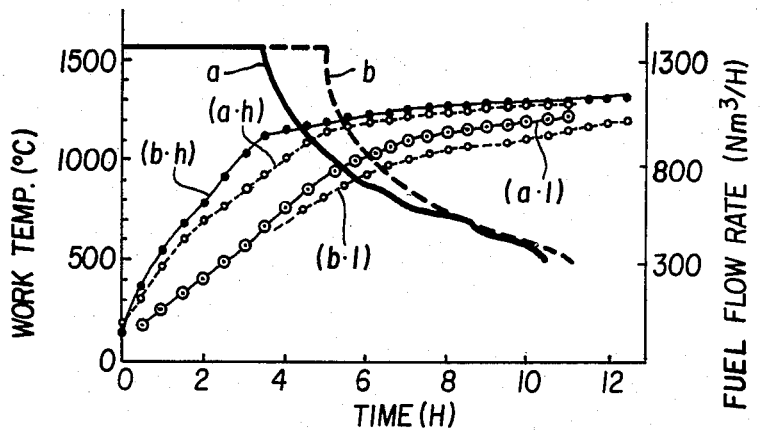
FIG. 12 is a graph showing transitional changes in fuel flow rate and temperature of heated work.

Turning now to the furnace temperatures (FIG. 11(III)), it is seen that the difference between the furnace temperatures on the side of and remote from the burner in the combustion according to the invention is about two times greater than in the conventional method. This is attributable to the fact that the temperature of the soaking furnace is controlled on the basis of the higher one of the two readings for the prevention of oversoaking and washing so that, upon increasing the atomizing rate, the flame radiation in the upper space of the furnace is reduced and the combustion gas temperature is elevated on the side remote from the burner as shown in FIG. 3. As a result, the hot combustion gas is circulated through the bottom portions of the steel ingots which are otherwise susceptible of insufficient heating, elevating the temperature of the bottom portions to a predetermined level in an accelerated manner within a shorter soaking period, allowing earlier extraction of the ingots from the furnace. Owing to this improved heating efficiency, the fuel consumption during the main combustion is reduced by about 8 to 12% or more in terms of prime units. As shown in FIG. 11(III), the temperature difference between the opposite end portions of the furnace during the combustion according to the present invention is about two times greater than in the conventional method. This however does not directly reflect localized heating since the works are heated more uniformly in the present invention irrespective of the greater difference in the furnace temperature, as seen from temperature curves of FIG. 12 which indicate the ingot temperatures as measured by thermocouples embedded in the respective ingots. In FIG. 12, curves a-h and a-l are of the maximum and minimum temperatures by the present invention while curves b-h and b-l are of the maximum and minimum temperatures by the conventional method. Curves a and b represent the fuel flow rates in the present invention and the conventional method, respectively. As is clear therefrom, the difference between the maximum and minimum temperatures of the work is smaller in the present invention owing to uniform heating. Why the local temperature of the heated work does not correspond to the local temperature of the furnace is explained by the fact that the furnace temperature is merely a local temperature at a position where a thermocouple is located.

EXAMPLE 1

Combustion in a top two-way firing type soaking pit was effected by steam-atomization and under the following conditions.

Maximum combustion rate: 650 l/h
Oil burner: Internal-mixing steam-atomization type
Fuel: Minas heavy oil
Air ratio: Oxygen ($O_2$) of about 1% (automatic $O_2$ control)

Figure 13I:
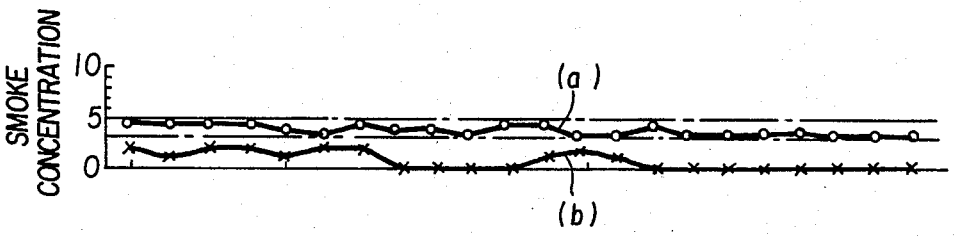
FIGS. 13(I) to 13(III) are graphs showing transitional changes in smoke concentration, CO concentration and fuel flow rate, respectively.

The rate of steam-atomization was controlled on the basis of the smoke or CO concentration in the exhaust gas. Smoke concentration was detected by a detector located in an exhaust gas port at the outlet of the furnace and controlled to a smoke concentration (Bacharach number) of 3 to 5. The transitional smoke concentration in the former case is shown in FIG. 13(I), in which curve a is a plot of atomizing rate control holding the smoke concentration in the range of 3 to 5 and cirve b is a plot of ordinary condition. In the latter case, the atomizing rate was controlled such that the CO concentration fall in the range of 100–400 ppm, the transitional changes in CO concentration being ploted in FIG. 13(II).

Figure 13:
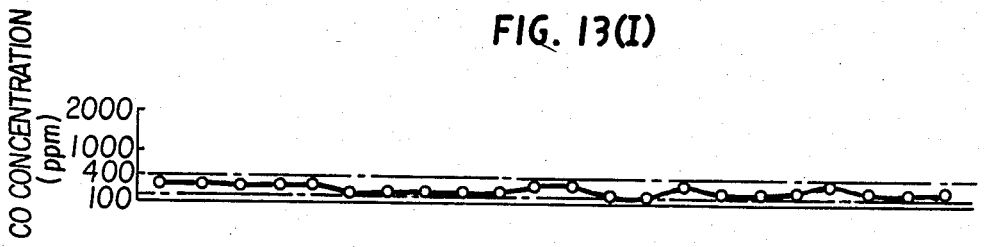

The turn-downs of the fuel flow rate in the atomizing rate controls based on the smoke and CO concentrations were the same. The transitional changes in the fuel flow rate is shown in FIG. 13(III), from which it is seen that the turn-down takes place earlier in the combustion with the atomizing rate control according to the present invention (curve a), as compared with the conventional method. The control of combustion according to the invention has an effect of reducing the fuel consumption by about 7–10% or more in terms of prime units.

EXAMPLE 2

Combustion was effected under the following conditions for melting operating in an aluminum melting furnace. In contrast to the soaking period in a soaking pit, the temperature distribution is out of question in an aluminum melting furnace, so that it suffices to control the atomizing rate in such a manner as to have maximum flame radiation within the furnace. FIGS. 14(I) and 14(II) show the relation between the atomizing rate ($Nm^3/l$) and the exhaust gas temperature (°C.) and the relation between the atomizing rate ($Nm^3/l$) and the intensity of flame radiation ($kcal/m^2h$) (measured at a position of $L/Lo=0.36$ where Lo is the total length of the furnace and L is a distance of the measuring point from the end face of the burner tile) during operation with a fuel flow rate of 300 l/h. In this combustion test, a temperature detector (a thermocouple) was located at the exhaust gas port at the exit of the furnace, and the atomizing rate was manually controlled in a manner to minimize the output signal from the detector, with an allowable smoke concentration of 5 in terms of Bacharach smoke number.

By controlling the atomizing rate during the total combustion process, the fuel consumption was reduced by 8% or more in average in terms of prime units and the melting time period was shortened to a considerable degree.

EXAMPLE 3

Steel ingots (hot ingots) were subjected to soaking in a top two-way firing type soaking pit under the following conditions.

Maximum combustion rate: 700 l/h
Oil burner: Internal-mixing air-atomizing type
Fuel: C-grade heavy oil
Air ratio: 1.2

Figure 15I:
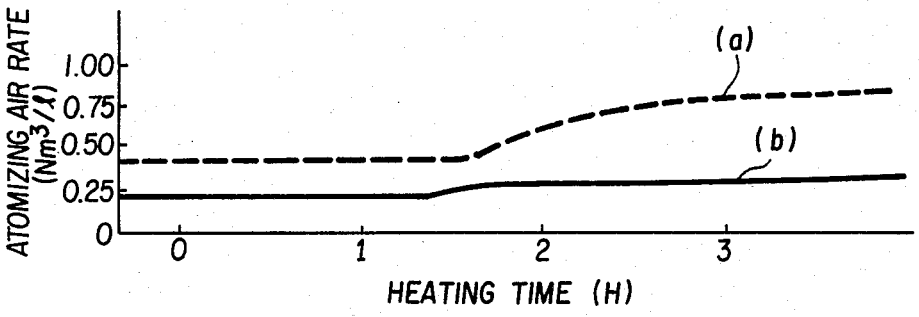

The atomizing medium (air) feed rate was adjusted as shown in FIG. 15(I) during the combustion process. In FIG. 15(I) curve a is of the conventional method and curve b is of the present invention. The atomizing rate was adjusted by an atomizing pressure regulator valve and in this example it was automatically adjusted in response to the fuel flow rate. In the conventional method, it is often the case that there is not provided an atomizing pressure control valve, and in such a case the atomizing rate of a furnace like soaking pit involving a large turn-down is determined on the basis of the heating period where the combustion rate is maximum, without controlling the atomizing rate in the soaking period. Therefore, the atomizing rate in the soaking period becomes greater than the standard atomizing rate by times corresponding to the inverse number of the turndown ratio. As a result, the difference in the atomizing rate between the present invention and the conventional method becomes greater than in FIG. 15(I).

Figure 15:
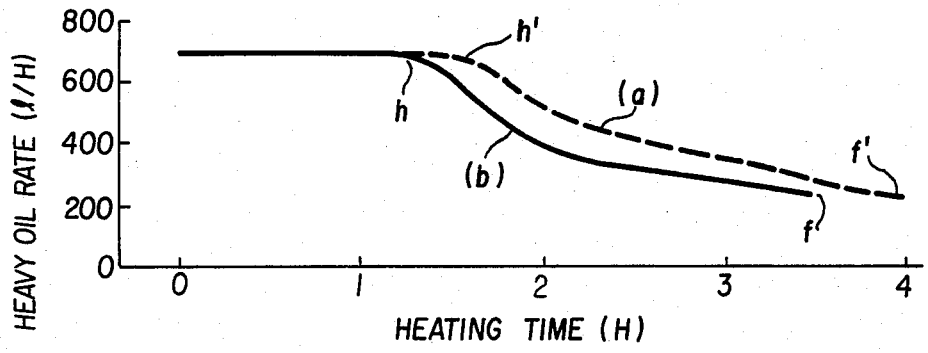

The results of the above combustion tests are shown in FIG. 15(II), in which curves a and b are of the conventional method and the present invention, respectively. The points h and h' and the points f and f' on these curves respectively indicate a time point where the soaking period is reached and a time point where the heated works are extracted from the furnace (soaking complete). As is clear therefrom, the combustion according to the invention (curve b) reaches the soaking period and completes the processing in the furnace earlier than the conventional method (curve a). This has an effect of reducing the fuel consumption by about 15% in terms of prime units.

EXAMPLE 5

Combustion was conducted in a one-way firing type soaking pit by steam-atomization and under the following conditions.

Maximum combustion rate: 530 l/h
Oil burner: Internal-mixing steam-atomizing type
Fuel: Minas heavy oil
Air ratio: 1.10

As shown in FIG. 16, the rate of steam-atomization in the present invention was maintained substantially at a constant level of about 0.4 kg/l in the heating period and above 0.4 kg/l in the soaking period. On the other hand, the atomization rate in the conventional method was adjusted below about 0.4 kg/l throughout the heating and soaking periods according to the ordinary procedure. Under these conditions, the exhaust gas temperature is increased when the atomizing rate is held above about 0.4 kg/l, as clear from FIG. 3 showing the relation between the rate of steam-atomization and the exhaust gas temperature. In this instance, as mentioned in the preceding example of air-atomization, the overall heat transfer efficiency in the furnace is lowered by the increased atomizing rate but the circulation of hot combustion gas to the bottom portions of the steel ingots contributes to improve the heating efficiency as far as local heating characteristics is concerned, accelerating the heating of the bottom portions of the steel ingots which are otherwise susceptible of insufficient heating. This has an energy-saving effect, more particularly, an effect of reducing the fuel consumption by about 5 to 10% or more in terms of prime units.

According to the present invention, in addition to or independently of the control of the atomizing rate, the tip end position of a burner is adjusted in such a manner as to have a maximum flame radiation in a desired locality of the furnace on the basis of predetermined correlation between the burner position and the distribution of flame radiation within the furnace over the fuel flow rate or combustion air flow rate.

Figure 17:
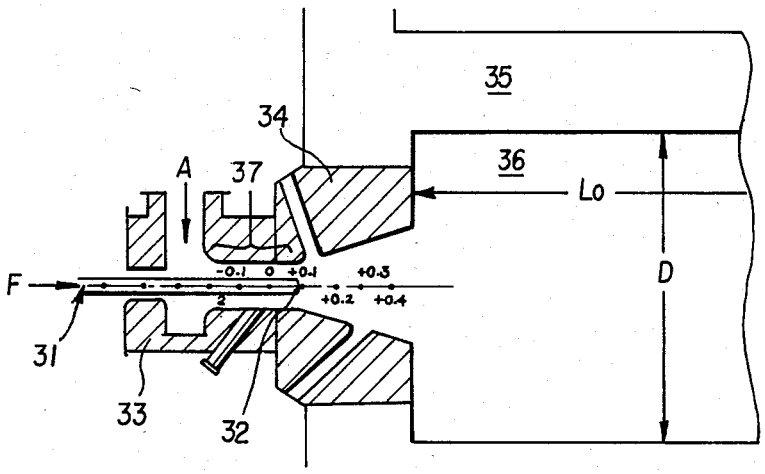
FIG. 17 is a schematic view of a burner construction of a horizontal furnace having a cylindrical refractory wall.

Referring to FIG. 17, there is shown an example of burner construction in a horizontal furnace with a cylindrical refractory wall having an inner diameter D of 1 m and a length Lo of 4 m. In FIG. 17, denoted at 31 is a burner, at 32 a burner tip end, at 33 an air register, at 34 a burner tile, at 35 a furnace wall, at 36 a combustion chamber, and at 37 a throat portion of the burner. A fuel FF (in the form of gas, liquid or finely divided solid particles) is fed to the burner 31 and, after atomization in the case of a liquid fuel, the fuel is sprayed into the combustion chamber 36 from the burner tip end 32. On the other hand, combustion air A is fed to the air register 33 from a blower and, after rectification at the burner throat portion 37, injected into the combustion chamber 36 and mixed with the fuel to form diffusing flames. The tip end portion 32 of the burner 31 is normally located at the O-position but movable in a predetermined range toward and away from the combustion chamber 36 for the control of the distribution of flame radiation. In the following description, the displacement of the burner tip end 32 toward the combustion chamber is regarded as positive and the displacement toward the air register as negative, and expressed by a non-dimensional number of its ratio to the inner diameter D of the combustion furnace (l/D). The numbers −0.2 to +0.4 graduated along the center axis of the burner in FIG. 17 indicate the positions of the burner tip end in terms of l/D.

Figure 18:
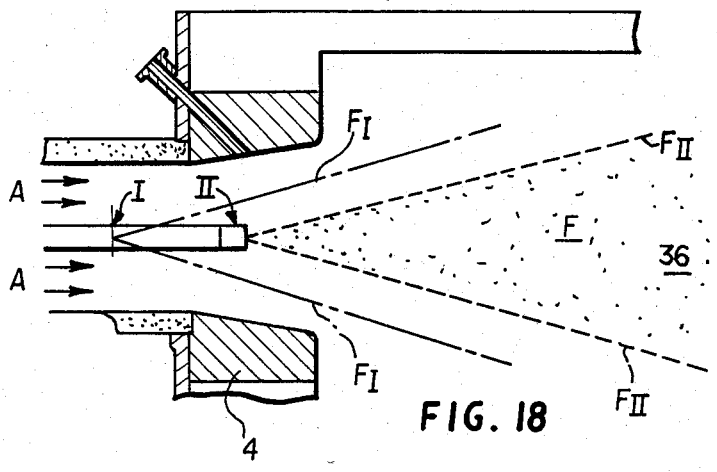
FIG. 18 is a diagram of combustion process.

FIG. 18 illustrates the control of combustion, in which the tip end of the burner 1 is located either at a normal position I or at an inwardly displaced position II, for example, by moving a burner or extending out a telescopically connected pipe. The broken lines $F_I$ and solid lines $F_{II}$ indicate the outer boundaries of diverging flows of injected fuel which are formed when the tip end of the burner is located at positions I and II, respectively. When the tip end of the burner is displaced from position I to II, the initial mixing point of the fuel F and combustion air A is shifted toward the furnace 36 and the major portions of the injected fuel and air are mixed within the furnace 36 where the velocity of air flow is relatively low, so that the combustion reaction zone is expanded to a wider range to effect slow combustion of long flame and in a uniform temperature distribution without local high-temperature regions. More particularly, in the combustion with the tip end of the burner located at the position I, the fuel is uniformly mixed with combustion air already at the inner end of the burner tile to undergo vigorous combustive reactions. On the other hand, when the tip end of the burner is shifted toward the furnace to inject the fuel at the position II, the sprayed fuel-rich zone which is initially divided from the surrounding lean zone is diffused and slowly mixed into the latter, completing the combustion in a region considerably downstream of the inner end of the burner tile. Therefore, the inward shift of the tip end position of the burner slackens the combustion, slowing down the mixing speed of the fuel with combustion air and as a result producing a large quantity of "soot". More particularly, with a liquid fuel, finely atomized particles of the oil are pyrolyzed by heat which is transferred from ambient flames, and produce coke-like soot of residual carbon form through polymerization or condensation to cause a sort of solid radiation in luminous flames as explained hereinbefore. With a gas fuel, hydrocarbon contents undergo the stages of dehydration, thermal decomposition, polymerization, production of unsaturated bonds and production of aromatic substances, thereby producing gas-phase precipitating type soot to increase luminous flame radiation.

Thus, it is possible to control the distribution of flame radiation through adjustment of the tip end position of the burner, obtaining a relatively flatened distribution with a high-level radiation in the vicinity of the burner by shifting the burner in the negative direction and obtaining a peaked distribution with an increased maximum value at a position distant from the burner by a shift in the positive direction.

Figure 19:
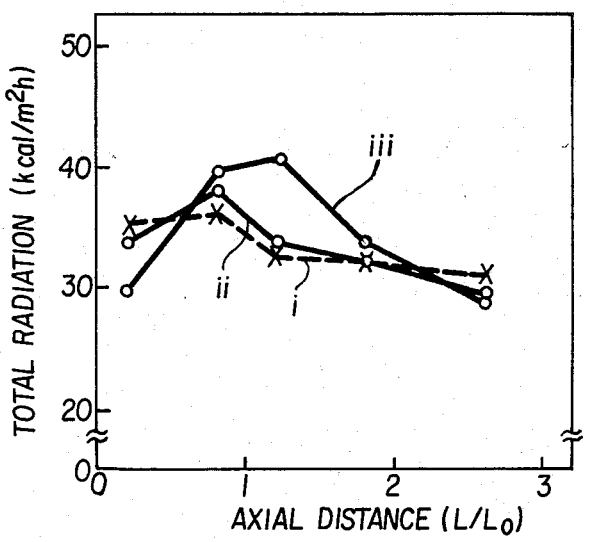
FIG. 19 is a graph showing axial distribution of total radiation.

FIG. 19 shows the relation between the tip end position of the burner and the distribution of total radiation (flame radiation+furnace wall radiation) in the combustion chamber in the refractory furnace wall having a length Lo of 4 m and an inner diameter of 1 m. The tip end position in the combustion chamber is indicated by a ratio (L/Lo) of the axial distance L from the inner end of the burner tile to the furnace length Lo (abscissa). In the graph of FIG. 19, curves I, II, and III show the axial distributions of total radiation when the tip end of the burner is located at positions (l/D) of −0.2, ±0 and +0.2, respectively, in the combustion process under the following conditions.

Figure 20I:
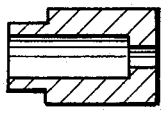
FIGS. 20(I) and 20(II) are schematic views showing examples of burner tip.

Fuel: C-grade heavy oil
Burner: Internal-mixing air-atomizing type
Burner tip: Straight type (having a fuel injecting hole parallel with axis of burner. (See FIG. 20(I))
Combustion rate: $40\times10^4$ kcal/h
Air ratio: 1.15
Combustion air temperature: 320° C.
Furnace temperature: 1300° C.

As seen in FIG. 19, the distribution of total radiation of curve I is relatively flat and lower in peak value as compared with that of curve II of normal position (l/D=0). As the burner tip end position is shifted toward the combustion chamber, the peak value and amplitude of radiation are increased and the pak position is shifted rearward (toward the posterior furnace end) as indicated by curve III. Therefore, for instance, in a case where works (e.g., steel ingots) in the furnace are placed in the positions (L/Lo) around 0.2 to 0.6, the tip end of the burner is adjusted to a position around −0.2 to produce the distribution of total radiation similar to curve I. If the works are in the positions (L/Lo) of 0.5 to 1.5, the tip end of the burner is located at a position (l/D) around +0.2 to produce a distribution of radiation similar to curve III which is suitable for uniformly heating the works with higher heat efficiency.

Figure 21:
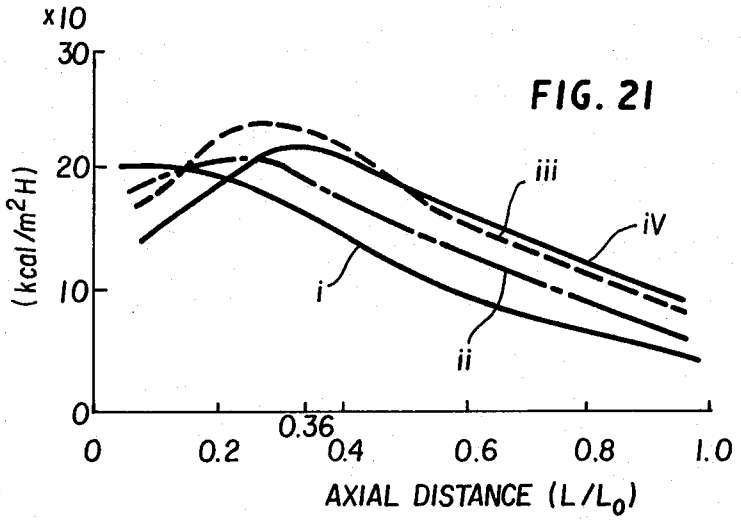
FIG. 21 is a graph showing axial distribution of total radiation in a melting furnace.
Figure 22:
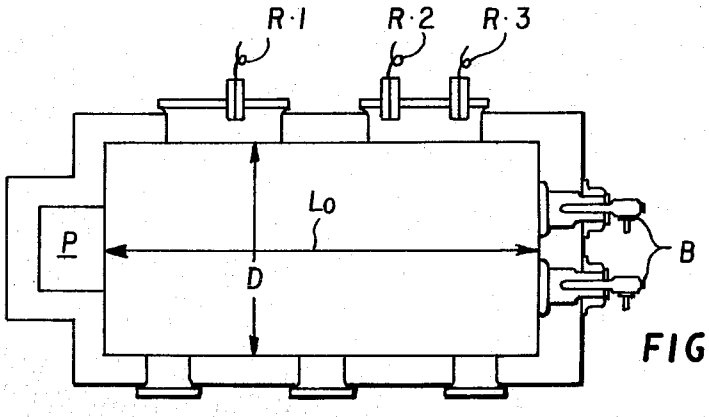
FIG. 22 is a schematic plan view of a melting furnace.

FIG. 21 shows the relation between the tip end position of the burner and the axial distribution of total radiation in heating and melting operation in an aluminum melting furnace. The axial positions within the melting furnace are indicated by a ratio (L/Lo) of the distant L from the inner end of the burner tile to the total inside length Lo, which is a stationary type melter having a rectangular shape as shown in FIG. 22 and having a total inside length Lo of 7.5 m and a width D of 3.6 m. In FIG. 22, indicated at B is a burner, at P a fume duct, and at R-1, R-2 and R-3 radiometers. In FIG. 21 which shows data for a fuel flow rate (heavy oil) of 300 l/h, curve I is of the burner tip end position l/D at 0, curve II of l/D at +0.013, curve III of l/D at +0.026, and curve IV of l/D at +0.039. It is observed therefrom that as the tip end position of the burner is shifted toward the furnace, the distribution of total radiation becomes higher at positions away from the burner. In this type of melting furnace, the heat transfer in the furnace and thus the energy-saving effect becomes greater with increases in the value of the total radiation as integrated in the longitudinal direction of the furnace. Therefore, in this particular example directed to a melting furnace, optimum conditions of combustion can be obtained by locating the tip end of the burner at the position l/D of +0.026. It is undesirable to shift the burner tip end position l/D inward to +0.039 since the distribution of total radiation becomes dominant on the side of the posterior end of the furnace and the combustion gas is discharged through the fume duct without effecting sufficient heat transfer. Thus, in this particular case, the maximum heat efficiency can be obtained by adjusting the tip end position of the burner on the basis of readings of a radiometer which is located at the position L/Lo of about 0.36 (a position of about 2.7 m from the inner end face of the burner tile). By this control, it becomes possible to reduce the fuel consumption by about 6% or more in prime units.

Figure 20:
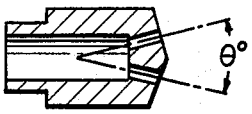
Figure 23:
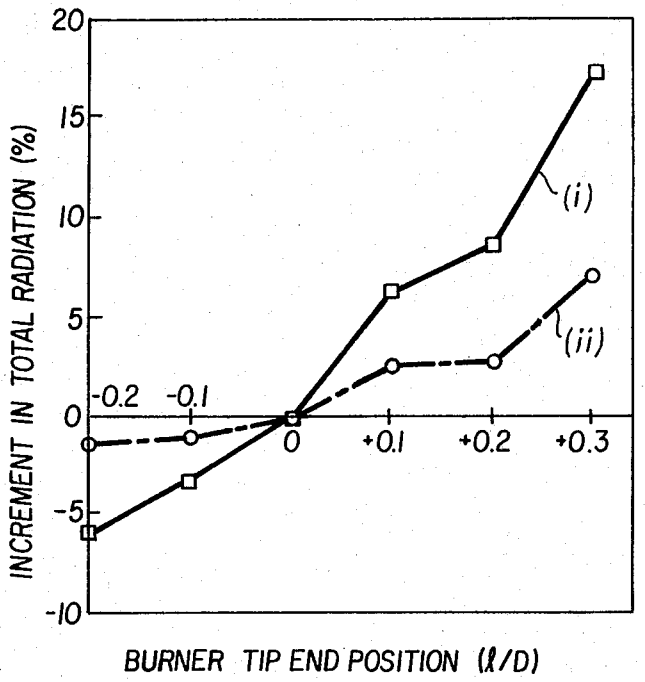
FIG. 23 is a graph showing increments in total radiation.

The graph of FIG. 23 shows the influences of the burner tip end positions on the total radiation at one exemplary position (a position L/Lo of about 0.8) during the combustion test of FIG. 19, in percentage to the total radiation of the normal burner position (l/D=0). In this graph, curve i is of a straight type burner (see FIG. 20(I)) and curve ii is of a cone type burner having an injection hole forming a predetermined cone angle $\theta$ to the axis of the burner (FIG. 20(II)). In any case, the total radiation and heat efficiency at the position L/Lo=0.8 are increased as the burner tip end is shifted in the positive direction (toward furnace). On the contrary, the total radiation decreases upon shifting the burner tip end in the negative direction (toward air register). It is also observed that a straight type tip has stronger effects on the flame radiation and is capable of increasing the radiation at a greater rate. This is because the straight type is more suited for slow combustion in which luminous flame radiation is increased to a considerable degree.

Figure 24:
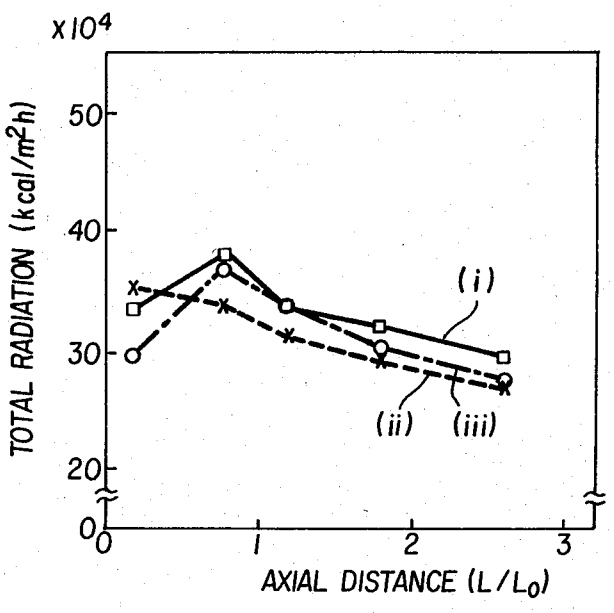
FIG. 24 is a graph showing total radiation at different combustion rates.

In actual operations, there normally occur transitional variations in the flow rates of the fuel and combustion air due to the control of the furnace temperature or other reasons, causing variations also in the distribution of flame radiation in the furnace. FIG. 24 shows distributions of total radiation at different combustion rates and burner tip end positions. In the graph of FIG. 24, curve i is of a combustion rate of $40\times10^4$ kcal/h and a burner tip end position (l/D) of 0, curve ii is of $20\times10^4$ kcal/h and l/D of 0, and curve iii is of $20\times10^4$ kcal/h and l/D of +0.2. Upon comparing curves i and ii, it is observed that the total radiation is lowered by a reduction in the combustion rate and the peak position of the radiation is shifted toward the burner due to shortened flame length. However, in such a case, the peak of the radiation can be replaced to an inner desired position by shifting the tip end of the burner toward the furnace, as will be understood from comparison of curves ii and iii. Thus, an optimum heating condition can be maintained by adjusting the tip end position of the burner counteractively to transitional changes in the combustion rate. For example, in a soaking pit having a turndown ratio of about 0.2, a distribution of radiation of good heat efficiency is maintained in the heating period of full combustion but the peak position of the radiation is shifted toward the burner upon a turndown in the soaking period, giving rise to problems of non-uniform heating, including insufficient heating of the works placed in positions remote from the burner. This problem can be avoided simply by shifting the burner tip end position toward the furnace to replace the peak of radiation to the initial inner position which ensures good heat efficiency.

Figure 25I:
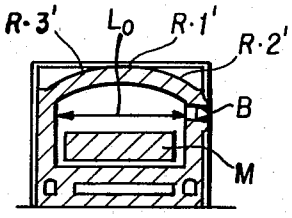
FIGS. 25(I) and 25(II) are schematic sections of a heating furance for forging, showing locations of a work and a radiation meter.
Figure 25:
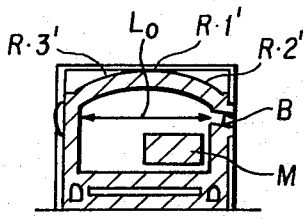

In actual applications, the tip end position of the burner (l/D or l/Lo) is adjusted such that the peak of total radiation is located at a desired position of the furnace. For this purpose, a radiometer may be located at a position where the peak of total radiation is desired, adjusting the position of the burner tip end on the basis of signals from the radiometer. Alternatively, the burner tip end position may be controlled on the basis of the correlation between the burner position and the distribution of total radiation over the fuel flow rate or combustion air flow rate, shifting the burner position in response to signals indicative of transitional changes in the fuel or combustion air flow rate. For example, in order to attain maximum heat efficiency in a forging furnace as shown in FIGS. 25(I) and 25(II) which involves variations in the shape, dimensions and position of a heating strip M (steel strip), it is necessary to locate the peak of total radiation substantially at the center of the heating strip M. For example, the burner position is adjusted on the basis of signals from a radiometer located at a center position R-1′ in a case as shown in FIG. 25(I) and a radiometer located at a position R-2′ closer to a burner B in a case as shown in FIG. 25(II). When the work strip is located on the side away from the burner B, the control is effected on the basis of signals from a radiometer which is located at the position R-3′. In this connection, it is advantageous to adjust the burner tip end position automatically, processing the signals from the radiometers by the hill-climbing method.

EXAMPLE 6

Steel ingots were heated in a forging furnace as shown in FIG. 25, burning C-grade oil at a combustion rate of 200 l/h and an air ratio of 1.2. The ingots were placed in the furnace as shown in FIG. 25(II) and the tip end of the burner was adjusted to a position where output signal from a radiometer located at the position R-2′ was maximum. The ingot temperature was measured by a thermocouple embedded in an ingot immediately beneath the radiometer R-2′ and in a depth of 50 mm from the surface of the ingot. For comparison, the same furnace was operated by the conventional method, fixing the burner tip end at the position of l/D=0.

Figure 26:
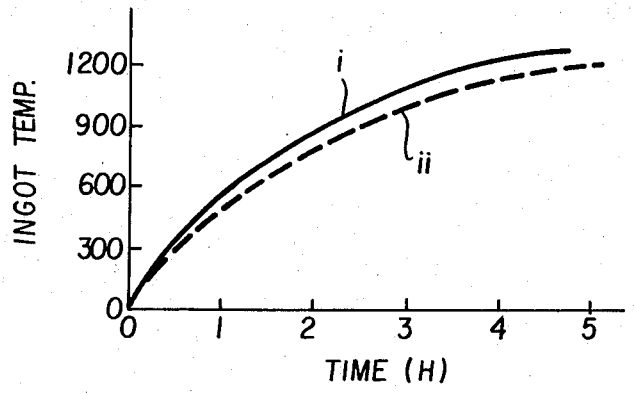
FIG. 26 is a graph showing increases in ingot temperature in a heating furnace for forging.

The temperature rises of the ingots in the foregoing tests are shown in FIG. 26, in which curve i is of the present invention and curve ii is of the conventional method. As seen therefrom, a higher heating efficiency is obtained by the method of the invention, heating up the ingot at an increased speed as compared with the conventional method. The method of the invention also showed an effect of reducing the fuel consumption by about 10% in prime units.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for controlling combustion of an atomized fuel in an industrial furnace in which the atomized fuel is injected into the furnace by a burner, said method comprising the steps of:

(a) establishing the correlation between total flame radiation in the industrial furnace and the feed rate of an atomizing medium per unit quantity of the fuel;

(b) establishing the correlation between the internal temperature distribution of the furnace and the feed rate of the atomizing medium per unit quantity of the fuel; then (c) feeding signals indicative of the fuel flow rate to a rationing unit operating on said correlations; and (d) automatically controlling the feed rate of the atomizing medium to an optimum value according to output signals from the rationing unit.

2. A method as set forth in claim 1 wherein the feed rate of the atomizing medium is automatically controlled according to signals obtained by superposing a bias signal on the output signals of a combustion air flow control meter.

3. A method as set forth in claim 1 wherein the feed rate of the atomizing medium is controlled such that the output signals of a temperature detector located in an exhaust gas duct of the furnace are held to a minimum.

4. A method as set forth in claim 3 wherein the output signals of the temperature detector are processed by a hill-climbing method.

5. A method as set forth in claim 1 wherein:

(a) the industrial furnace is a fluid-atomizing type oil furnace using air as the atomizing medium;
(b) the feed rate of the atomizing medium is adjusted above a lower critical value at which production of combustible substances commences;
(c) the feed rate of the atomizing medium is adjusted below a higher critical value of 0.26 $Nm^3/l$.

6. A method as set forth in claim 1 wherein:
(a) the industrial furnace is a fluid-atomizing type oil furnace using steam as the atomizing medium;
(b) the feed rate of the atomizing medium is adjusted above a lower initial value at which production of combustible substances commences; and
(c) the feed rate of the atomizing medium is adjusted below a higher critical value of 0.19 kg/l.

7. A method as set forth in claim 10 wherein:
(a) the industrial furnace is a top one-way firing soaking pit employed for a combustion process using a soaking pit;
(b) the industrial furnace uses air as the atomizing medium; and
(c) the feed rate of the atomizing medium is adjusted to a value greater than 0.5 $Nm^3/l$ during the soaking period.

8. A method as set forth in claim 1 wherein:
(a) the industrial furnace is a top one-way firing soaking pit employed for a combustion process using a soaking pit;
(b) the industrial furnace uses steam as the atomizing medium; and
(c) the feed rate of the atomizing medium is adjusted to a value greater than 0.4 kg/l during the soaking period.

9. A method as set forth in claim 1 and further comprising the steps of:
(a) establishing the correlation between the position of the distal tip end of the burner and the distribution of flame radiation within the furnace for a plurality of fuel flow rates or combustion air flow rates and
(b) adjusting the position of the distal tip end of the burner to a position suitable for locating the peak of the distribution of flame radiation at a desired locality in the furnace in response to signals indicative of the fuel flow rate or the combustion air flow rate.

10. A method as set forth in claim 1 and further comprising the steps of:
(a) providing a radiometer at a position within the furnace approximately where the peak of flame radiation is to be located;
(b) detecting with the radiometer variations in intensity of the radiation in response to shifts in position of the distal tip end of the burner; and
(c) effecting combustion while holding the distal tip end of the burner at a position where the output signal from the radiometer becomes maximum.

11. A method as set forth in claim 1 wherein:
(a) the correlation between flame radiation and the feed rate of the atomizing medium is established for a plurality of different ratios of the feed rate of the fuel to the feed rate of the atomizing medium and
(b) the correlation between the internal temperature of the furnace and the feed rate of the atomizing medium is established for a plurality of different ratios of the feed rate of the fuel to the feed rate of the atomizing medium.

* * * * *